United States Patent [19]

Horimatsu

[11] Patent Number: 4,519,730

[45] Date of Patent: May 28, 1985

[54] METHOD FOR CONSTRUCTING UNDERGROUND STRUCTURE

[75] Inventor: Kazuo Horimatsu, Funabashi, Japan

[73] Assignee: Tekken Construction Co., Ltd., Japan

[21] Appl. No.: 572,383

[22] Filed: Jan. 20, 1984

[51] Int. Cl.[3] ..... E21D 9/00

[52] U.S. Cl. ..... 405/258; 405/132; 405/138; 405/146; 405/150

[58] Field of Search ..... 405/258, 132, 138, 139, 405/140, 141, 146, 150, 149, 284, 285

[56] References Cited

U.S. PATENT DOCUMENTS

| | | | |
|---|---|---|---|
| 3,925,994 | 12/1975 | Broms et al. | 405/258 |
| 4,009,579 | 3/1977 | Patzner | 405/138 |
| 4,150,910 | 4/1979 | Maffei | 405/149 |
| 4,329,089 | 5/1982 | Hilfiker et al. | 405/262 |
| 4,345,856 | 8/1982 | Tuck | 405/258 |
| 4,421,439 | 12/1983 | ter Burg et al. | 405/258 |

*Primary Examiner*—Dennis L. Taylor

*Attorney, Agent, or Firm*—Leydig, Voit, Osann, Mayer and Holt

[57] ABSTRACT

A method of building a hollow structure in an embankment during its embanking work, wherein portions inside the embankment which are to form slope or side wall layers of later excavated cavity for the structure are embanked simultaneously with remaining portion of the embankment, with a plurality of nets buried as vertically spaced and to substantially horizontally intersect sliding surfaces appearing in said layers upon excavation of the cavity, upper ceiling portion of the cavity later excavated is prestressed during further embanking work by means of at least crushed stone filling between supporting plates buried respectively above each of said slope layer portions as opposed to each other with their surface and coupled by steel wires tightly hung between them, and after completion of the embanking work the cavity is excavated by removing embanked material in a zone surrounded by the slope layer portions and prestressed ceiling portion, so that the structure can be built within the cavity with the slope layers and ceiling layer highly stably maintained as prevented from being collapsed by the nets buried in the layers and favorably interlinking with the embanked material and crushed stone layer held between the supporting plates across the cavity.

5 Claims, 5 Drawing Figures

METHOD FOR CONSTRUCTING UNDERGROUND STRUCTURE

This invention relates to a method of building a structure in an embankment.

When such a new road as a high way is constructed to intersect already existing roads, rivers, water-ways or the like, in general, there has been employed such a method than an embankment is built at least over the existing road or the like to have the new road constructed on the embankment in a two level crossing. In this case, it is necessary to build a structure transversely through the embankment so as to secure a space necessary for retaining the existing road or the like. The structure to be thus built in the embankment includes specifically concrete-made tunnel, substructures for a bridge, box structure or the like, and the peripheral portions of the structure in the embankment must be sufficiently stabilized so as to prevent its side walls and ceiling from being collapsed or broken.

Referring more specifically to this conventionally employed method with reference to FIG. 1, when a new road NR is constructed, a buried structure SB such as a tunnel is initially built as reinforced by a concrete wall or the like over each of, for example, an existing road OR and a water-way WR, and thereafter an embankment is to be constructed further over the structures SB for the new road construction but, in order to transport embanking materials to the site of the new road, it is necessary to provide preparatory construction roads PR leading to respective parts of the site between the existing road OR and water-way WR and beyond the former.

According to this method, however, the embanking work for the new road construction must be performed after sufficient hardening of such material of the structure SB as concrete because, at each time when the new road crosses each existing road or the like, the structure SB must be built prior to the new road construction, and it has been impossible to continuously construct the new road but only intermittently, so that the construction period would be prolonged. Yet, the provision of the construction road PR in order to avoid the construction period's prolongation caused when the thus intermittently made new road is utilized for the embanking material transportation, rather requires a larger amount of costs and is even occasionally impossible for geographic reasons.

A primary object of the present invention is, therefore, to provide a method of building a structure in an embankment which allows a continuous construction of a new road without any interruption so as to be achievable even when the new road crosses existing roads, water-ways and the like.

Another object of the present invention is to provide a method of building a structure in an embankment which enables it possible to effectively utilize the new road being constructed to perform the embanking work for its crossing zone with existing roads and the like without requiring any provision of the construction road for such work.

Still another object of the present invention is to provide a method of building a structure in an embankment which contributes to a remarkable reduction of construction period for new roads and the like and is thus high in the economy.

Other objects and advantages of the present invention shall be made clear in the following explanation of the invention detailed with reference to an embodiment illustrated in accompanying drawings, in which:

FIG. 1 is a schematic diagram for explaining a conventional method of constructing a new road transversing existing road and the like;

Figure 3:
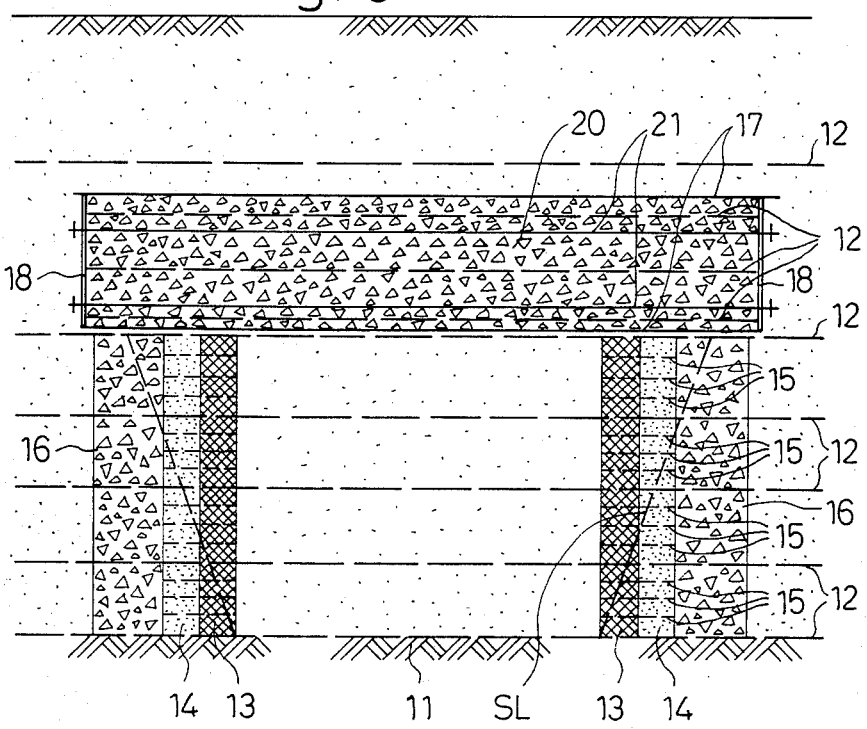
FIG. 3 is a fragmentary cross section of the embankment made according to the present invention and showing its entire height for showing the state in which the side wall layers of FIG. 2 and a prestressed upper ceiling part are made for the hollow structure later excavated.
Figure 4:
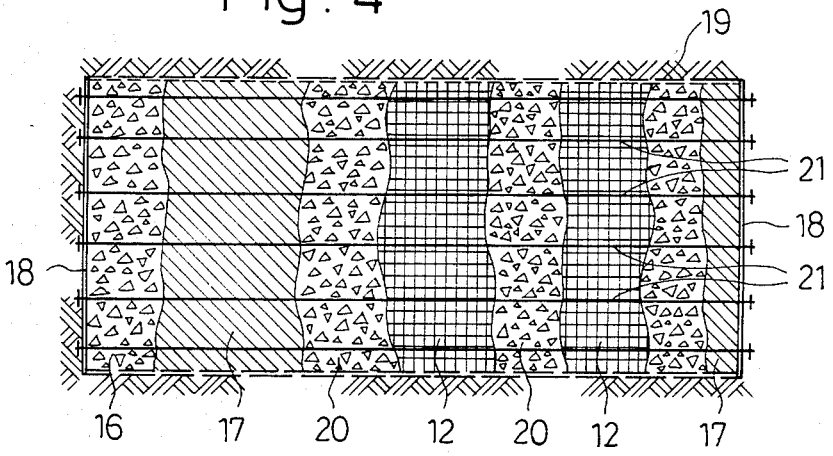
Figure 5:
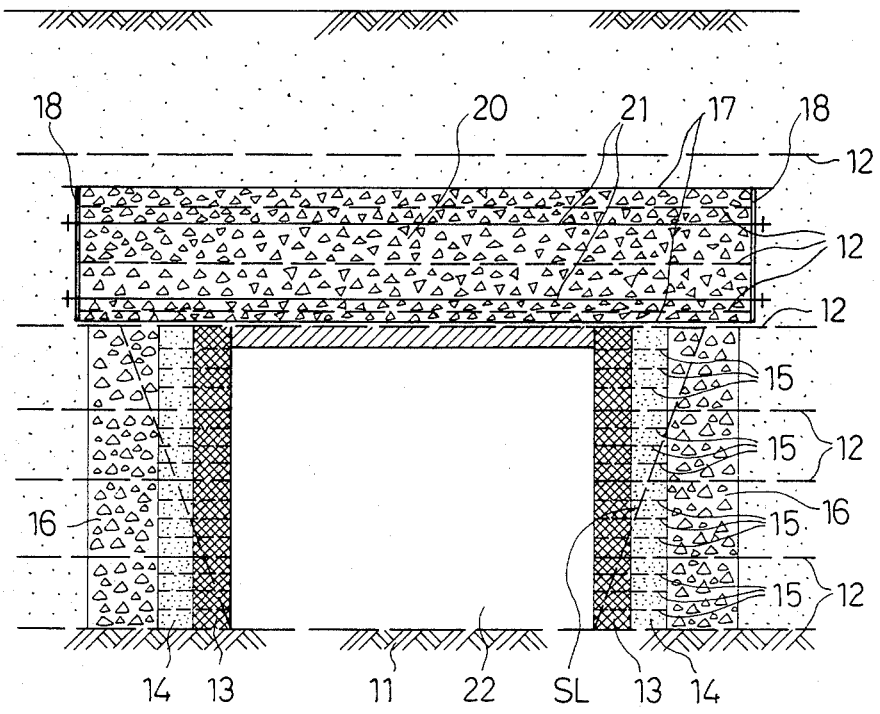

FIG. 4 is a fragmentary top plan view of the prestressed ceiling part of FIG. 3, showing respective layers and materials forming the part with upper positioned ones of each of them removed sequentially from the left end showing the bottom to the right end showing the top; and FIG. 5 is a fragmentary cross section of the embankment of FIG. 3 but in its state where a tunnel has been excavated by removing embanked materials in a zone defined by the side wall and upper ceiling layers and foundation ground for the hollow structure in the embankment.

It should be understood that the present invention is not limited only to the illustrated embodiment but is to rather include all alterations, modifications and equivalent arrangements possible within the scope of appended claims.

Figure 1:
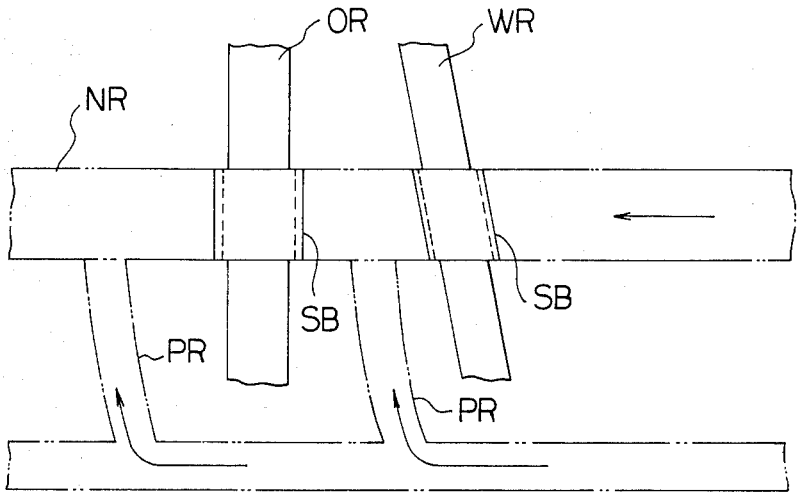
Figure 2:
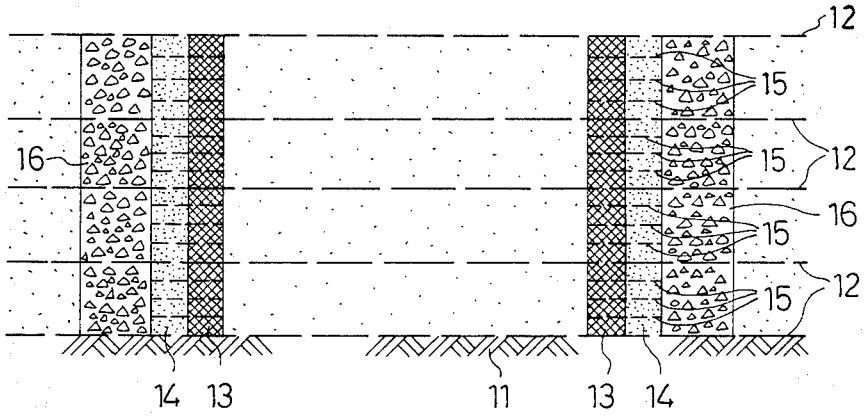
FIG. 2 is a fragmentary cross section of an embankment specifically at its portion forming side wall layers of a hollow structure to be built in the embankment made according to the present invention for the new road construction.

The method of building a structure in an embankment according to the present invention shall be detailed with reference to FIGS. 2 to 5. Referring especially to FIG. 2, in the present method, a buried net 12 made preferably of polyethylene threads is initially placed horizontally on a foundation ground 11 at the site of making the embankment substantially over the entire surface of the site. For the net 12, the polyethylene threads of a tensile elastic modulus of 7.0 $Kg/cm^2$ are meshed to provide a grid of 2.5 to 3.0 cm and to have an allowable tensile-resisting stress of about 1.000 Kg/m.

In order to form the respective two opposing side wall portions of such an intended structure as a tunnel of, for example, a rectangular cross section, as spaced horizontally and erected on the ground 11 inside the embankment, a soil cement layer 13 for each cemented side wall of the tunnel and a slope soil layer 14 on each opposite outer side of the cemented side walls are built up during the embanking work on the initially placed buried net 12, with a plurality of slope nets 15 embedded in the layers 13 and 14 as vertically spaced at intervals of preferably 10–15 cm. The slope nets 15 are made of polyethylene threads of a smaller size than that of the buried net 12 so as to have an allowable tensile-resisting stress of about 500 Kg/m. Further, a crushed stone layer 16 preferably of a width substantially corresponding to the total width of the each side soil cement and slope soil layers 13 and 14 is also built up on the outer side of each slope soil layer 14 while embanking materials are built up on the inner and outer sides of the both side wall portions thus being erected with the respective layers 13 to 16. After the soil cement and slope soil layers 13 and 14 with the slope nets 15 embedded therein and crushed stone layer 16 as well as the embankment have been built up to be 40 to 60 cm high, a further buried net 12 is placed thereon horizontally. Such embanking and wall-forming work is repeated while providing a sufficient rolling compaction, until a required height of the tunnel or the like structure is reached.

Further, referring to FIGS. 3 and 4, after the upper surface of the embankment having the required height for the structure is sufficiently rolled and flattened, a still further buried net 12 is placed on the flattened embankment and then a reinforcing sheet 17 preferably made of plastic material and having a considerable thickness is placed as spread immediately on the net 12. In this case, the buried net 12 has an area or size substantially covering the entire surface of the ground, whereas the reinforcing sheet 17 is set to have an area or size nearly corresponding to the upper surface of the structure to be built.

Above the buried net 12 and reinforcing sheet 17, supporting plates 18 preferably made of a steel plate are disposed as opposed to each other with their flat surface so that the plates are positioned respectively slightly outside of the outermost crushed stone layers 16 of the both side wall portions. In this case, the support plate may be provided with a horizontally-extending skirt portion or may be temporarily mounted on a separate holding plate (not shown) which extends horizontally. Further, soil retaining plates 19 may be disposed as erected between the opposed supporting plates 18 so that the plates 18 may be stably erected. Next, a comparatively small amount of crushed stone 20 is flatly placed between the supporting plates 18. Then, a buried net 12 is spread over the crushed stone layer between the plates 18, prestressing steel wires 21 are hung across the opposing supporting plates 18 as secured to the plates at both ends by any proper means such as welding or bolt-and-nut attached as passed through the plates. The steel wire 21 should preferably be made of rust resistive material and a plurality of them are arranged in horizontal and mutually parallel relation.

Further, a next layer of the crushed stone 20 and a small amount of fine grained sands are placed between the supporting plates 18 and over the already placed crushed stone layer and prestressing wires, a next buried net 12 is provided in the present instance substantially at an intermediate level of the height of the supporting plates 18. Above this buried net 12, as in the above, further prestressing steel wires 21 are secured between the supporting plates 18 in the same manner, a further layer of the crushed stone 20 and small amount of fine grained sands is formed over the last-mentioned buried net 12 and steel wires 21, a further buried net 12 is placed on the further crushed stone layer between the supporting plates 18, and an additional layer of crushed stone 20 is formed up to the top end level of the plates 18. The reinforcement sheet 17 is placed at the top level of the thus formed crushed stone layers filling between the opposed supporting plates 18 while the embanking work for the entire embankment is performed, and the sufficient rolling compaction is repeated with respect to the embanked materials and crushed stone layers 20 between the supporting plates 18. The embanking work is thereafter continued while providing rolling compaction and placing therein a proper number of the buried nets 12 covering the entire surface of the embanked materials as vertically spaced from each other.

During this continued embanking work and preferably when the height of the embankment reaches a level between 0.5 and 1.0 m above the reinforcement sheet 17 on the crushed stone layers 20 so that the ground pressure of embanked material onto the layers 20 will be remarkable, a prestress is applied to the steel wires 21 so that they are tightened and the entire body of the crushed stone layers 20 will be a prestressed ceiling part of the intended tunnel or the like structure. For this purpose, the securing at one end of the wires to the supporting plate 18 on one side is initially made in a temporary manner, a proper working space is left outside the particular plate 18 for disposing therein center-hole jacks (not shown) to couple them to the temporarily secured end of the wires 21, and the jacks are driven to have the wires firmly secured in tightened state to the plate 18 by means of the welding or bolt-and-nut, with a sufficient prestress provided. During this prestressing operation, the fine grained sand mixed with the crushed stone 20 to fill between the supporting plates 18 will act to provide a proper sliding effect to the steel wires 21 so that the wires can be smoothly tightened while not subjected to any substantial friction of respective pieces of the crushed stone 20.

When the prestressing operation is completed, the working space with the jacks removed is filled with the embanking material as roll-compacted to the level already reached, and the embanking work is further continued with any further buried net or nets 12 as required until the required height of the embankment is reached while repeating the rolling compaction. It will be understood to those skilled in the art that, in the thus built embankment, the prestressed ceiling part mainly comprising the crushed stone layers 20 between the supporting plates 18 functions substantially as a sort of solid flat plate which bridges across the crushed stone layers 16 erected below the layers 20 to act as supporting walls.

After the completion of the foregoing embanking work, the zone defined by the foundation ground 11, inner walls of the soil cement layers 13 and the bottom reinforcement sheet 17 is excavated while cutting and removing the buried nets 12 with the embanked materials within the zone to form a cavity 22 as in FIG. 5. During the formation of the cavity 22, the embanked materials tend to slide along such an imaginary sliding surface extending diagonally through the slope layers 14 and soil cement layers 13 as shown by dotted lines SL in FIG. 3 or 5 so that the side walls of the cavity may be collapsed. According to the present invention, however, the peripheral portions of the cavity 22 in the embankment are sufficiently strengthened and any collapse of the side walls of the cavity will not take place, because of the provisions of the buried nets 12 and slope nets 15 which cooperate with the soil cement 13, slope soil 14, crushed stone 16 and embanked materials. More particularly, the buried nets 12 and slope nets 15 present in the slope layers 14 of soil and passing through the sliding surface SL horizontally are subjected to a tensile force due to a sliding force of the soil generated along the sliding surface SL. When this tensile force is imparted to the nets, the soil compacted within respective net meshes so as to form on a microscopic scale a column in each mesh receives a shearing force of the net-forming threads and this shearing force transmitted to the respective columns of soil cancels the tensile force, whereby the entire soil on the sliding surface SL can be stably retained. In other words, when the total strength of the respective nets and soil columns in the nets is greater than the sliding force, the nets and soil columns will not behave themselves independently of each other, so that the embanked soil in the layers 14 along the sliding surface SL can be reliably stably retained. Further, the buried nets 12 function not only to stabilize the sliding surface SL as in the foregoing but also to prevent the crushed stone layers 16 from being horizontally displaced, so that the horizontal shearing force of the nets can be increased and thus the stabilization of the side walls can be also increased.

It will be easily understood by those skilled in the art that the function of the buried nets 12 in the side wall portions as referred to above can apply substantially similarly to the upper ceiling portion comprising mainly the crushed stone layers 20 between the supporting plates 18, in which the buried nets 12 and crushed stone layers 20 can be made integral with each other and also with surrounding embanked materials and, as the layers 20 are prestressed, the ceiling portion can be made firm as if it were a solid block, whereby the peripheral parts of the cavity 22 can have a strength substantially equal to or even higher than that of any conventional structure preliminarily built. In addition, after the excavation of the cavity 22, the soil cement layers 13 and lower part of the prestressed ceiling portion between the supporting plates 18 may be utilized to form a permanent retaining structure surrounding the cavity 22 with their high durability, while a proper lining wall material may be applied on the inner wall of the structure, if required.

Further, the present invention can be modified in such various manners as follows:

When, for example, a certain amount of foamed styrol fragments is mixed with the crushed stone 20 and fine grained sand in forming the prestressed ceiling portion, any displacement of the crushed stone 20 can be smoothly prevented and thus the crushed stone can be favourably prevented from being unstabilized and collapsed. Further, when a foamed styrol layer is provided in the vicinity to the periphery of the cavity 22, vibrations therein caused by earthquake or the like can be absorbed by such layer to further stabilize the periphery.

While in the illustrated embodiment the portions forming the side walls of the cavity 22 are shown to include the soil cement layers, the portions may even comprise only the slope layers of soil, in which event, too, the cavity 22 can be sufficiently stabilized and, if necessary, cement may be applied to the upper and side surfaces of the cavity 22 after the cavity is formed. Further, the number of buried nets 12, slope nets 15 and steel wires 21 may be properly increased or decreased depending on the region in the embankment and the like conditions of the construction site. Though the prestressed ceiling structure between the supporting plates 18 is made to be preferably symmetrical with respect to the buried net 12 positioned at the middle level of the supporting plates 18, the structure may be a symmetric. Furthermore, the prestressing steel wires 21 have been arranged in two stages but they may be provided in any increased or decreased stages. Yet, one or both of the reinforcing sheets 17 provided on and below the prestressed ceiling structure may be replaced by an iron plate, rust resisting steel plate, concrete plate or the like rigid member.

According to the method of the present invention as has been disclosed, the embanked layer structure right above the cavity already formed in the embankment can sufficiently endure the weight of running vehicles during the continuous constructions of the embankment or the new road extended, trucks for transporting embanking materials and so on can be allowed to run immediately on the embanked new road having the formed cavity and thus it becomes unnecessary to provide any construction road for the new road construction. In addition, since it is unnecessary to wait for completion of the hollow structure as in the prior art, the new road can be extended even before excavation of the cavity, whereby the construction period can be reduced to a large extent and the construction cost can be well economized.

What is claimed is:

1. A method of building a cavity structure in an embankment during its embanking work at a position corresponding to an existing road, water-way or the like in constructing a new road across said existing road or the like with said embankment, said method comprising the steps of forming at least slope layers of soil acting as side walls of an intended cavity to be later excavated for said structure, with a plurality of nets buried substantially horizontally in said layers as mutually vertically spaced and to intersect substantially sliding surfaces appearing in the layers when excavating said intended cavity, performing said embanking work with respect to peripheral portions of said slope layers, providing spaced supporting plates as opposed to each other respectively at each outer side position of a region right above the intended cavity when a required height for the cavity of the embankment is reached, providing prestressing wires between said plates, forming layers of at least crushed stone between the plates with a plurality of nets as spread therebetween and as mutually vertically spaced, tightening said prestressing wires to provide a prestress to said crushed stone layers between the plates, continuing the embanking work over said prestressed crushed stone layers and peripheral portions to complete the embankment, and excavating a zone defined by the slope layers and crushed layers to provide the cavity.

2. A method according to claim 1 which further comprises steps of forming a soil cement layer erected inside each of said slope layers, and forming crushed stone layer erected outside each of the slope layers, respective said erected layers also acting as said side walls of said intended cavity.

3. A method according to claim 1 wherein said step of forming said crushed stone layers between said supporting plates includes steps of mixing fragments of foamed styrol with said crushed stone, and providing reinforcing sheets on the bottom and top planes of said crushed stone layers.

4. A method according to claim 2 wherein said steps of forming said slope layers and soil cement layers include a step of burying a plurality of slope nets as mutually vertically spaced by a relatively small distance between said buried nets.

5. A method of claim 1 wherein said step of forming said crushed stone layers includes a step of providing other buried nets and reinforcing sheets in symmetrical relation to said buried net which is positioned at the middle level of said supporting plates.

* * * * *